United States Patent [19]

Reeves

[11] Patent Number: 4,689,889

[45] Date of Patent: Sep. 1, 1987

[54] DEVICE FOR SUPPORTING A BUILDING LINE REFERENCE

[76] Inventor: Raymond A. Reeves, 9 Matravers Road, Great Malvern, Hereford & Worcester, England

[21] Appl. No.: 733,235

[22] Filed: May 10, 1985

[30] Foreign Application Priority Data

May 19, 1984 [GB] United Kingdom ..... 8412876

[51] Int. Cl.[4] ..... G01C 15/10

[52] U.S. Cl. ..... 33/408; 33/1 LE; 248/539

[58] Field of Search ..... 33/404, 408, 406, 407, 33/413, 405, 409, 410, 414, 1 LE; 248/534, 539, 535, 511

[56] References Cited

U.S. PATENT DOCUMENTS

| | | | |
|---|---|---|---|
| 1,004,194 | 9/1911 | Platt | 33/406 |
| 1,060,284 | 4/1913 | Platt | 33/410 |
| 2,634,740 | 4/1953 | Duke | 248/539 X |
| 2,666,260 | 1/1954 | Schneider et al. | 33/407 |
| 3,127,684 | 4/1964 | Ernst | 33/408 |
| 4,057,903 | 11/1977 | Cantera | 33/406 |

FOREIGN PATENT DOCUMENTS 2120718 7/1983 United Kingdom .

OTHER PUBLICATIONS

European Patent Application, 0033992, 19/08/81, Voskanys.

European Patent Application 075,089, 29/06/83, Hummel.

*Primary Examiner*—William D. Martin, Jr.

*Attorney, Agent, or Firm*—Kenway & Jenney

[57] ABSTRACT

A device for supporting a building line reference consists of an elongate plate member for adjustable attachment to a wall face having upper and lower parallel channels, and a vertically oriented square section hollow member, in which said reference is received, secured to a plate slidably engaged in said channels having means for locking the plate against slidable movement. Said hollow member including two horizontal pivot bars located on the inside of two adjacent walls and threaded holes formed in said other two adjacent walls and positioned above and below said pivot bars whereby the reference member may be urged against said bars and brought into vertical orientation by the adjustment of threaded bolts received in said threaded holes.

4 Claims, 7 Drawing Figures

DEVICE FOR SUPPORTING A BUILDING LINE REFERENCE

The present invention relates to a device for supporting a building line reference.

When building walls of a brick structure it is important that they are true vertically and that the bricks lie horizontal in their courses. Traditionally this has been achieved by a skilled bricklayer building up the corners of the structure first, on the footing, taking great care to ensure that the corners are absolutely true. This method of construction requires great skill and experience and is time consuming. The portion of the wall between the corners is completed by laying bricks in forward and backward runs and this portion of the building can be done by relatively inexperienced bricklayers.

In the past it has been proposed to use free-standing devices to provide a constant reference for the bricklayer in order to limit the amount of time taken in laying the bricks course by course. However, known devices of this type are extremely complicated and cumbersome. They are also limited in their use in that they are designed either to provide a reference on an external corner or an internal corner, but not both. Furthermore such devices are unable to provide a reference for projections, e.g. chimney breasts, on the building line.

I have now developed an improved device that is relatively simple in construction, can be used to provide a reference for a building line on both internal and external walls through easy attachment to any brickwork and is capable of adjustment to provide a reference for projections from the building line.

In this specification the terms 'bricks' or 'brickwork' includes any type of block structure used in building work, e.g. standard house bricks, breeze, concrete and insulating blocks and reconstitued stone blocks.

The term footing means the bottom unit of a wall or other vertical structure such as a pillar.

The invention provides a device used to support a reference for a building line comprising, a first member releasably attachable to a footing or wall structure, and a second member releasably engageable with the said first member and including means to grip one end of a building line reference and to position said reference in a vertical orientation, the relative position of said second to said first member being adjustable.

Preferably said first member includes upper and lower horizontal channels and said second member includes means for engaging in said channel; most preferably further means are provided to lock the said second member in a fixed position relative to said first member.

Figure 1:
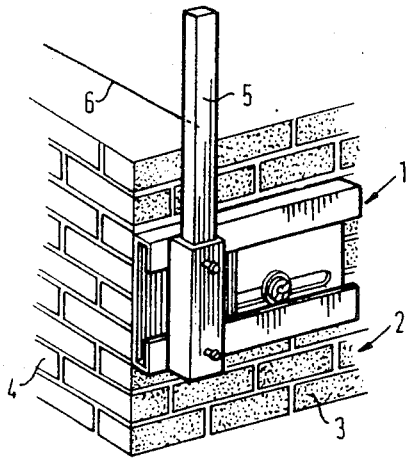
Figure 2:
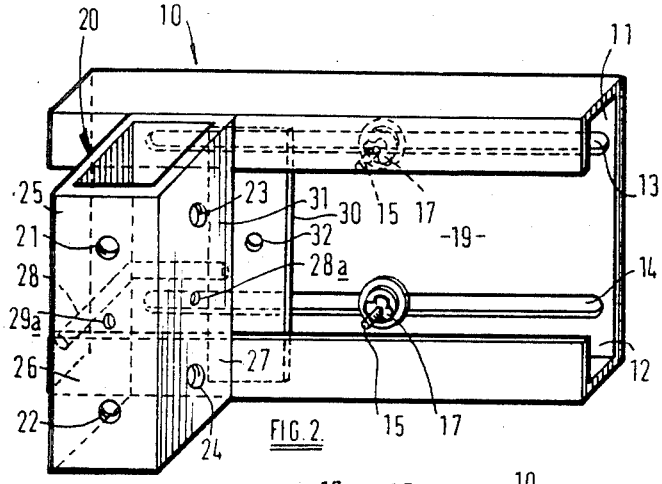
Figure 3:
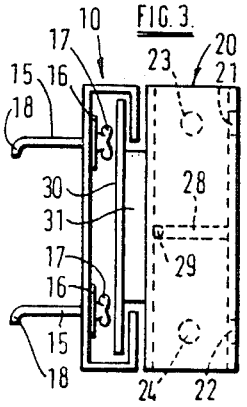
Figure 4:
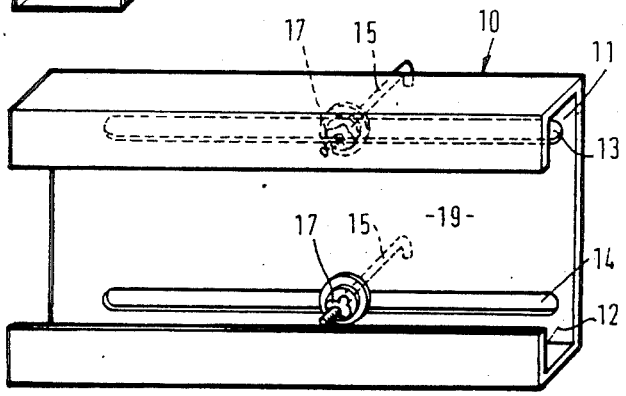
Figure 5:
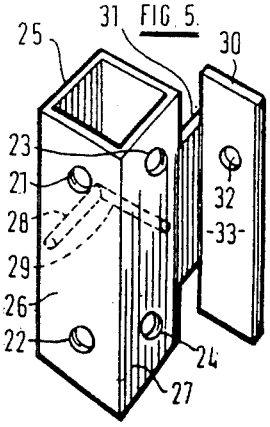
Figure 6:
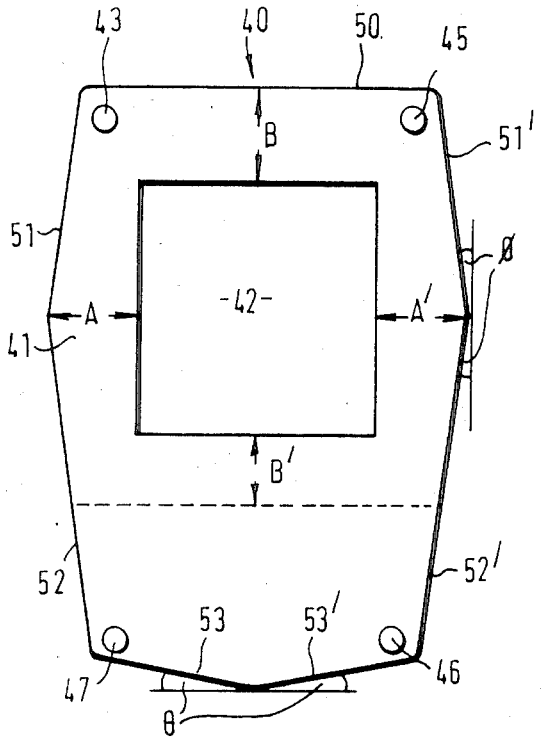
Figure 7:
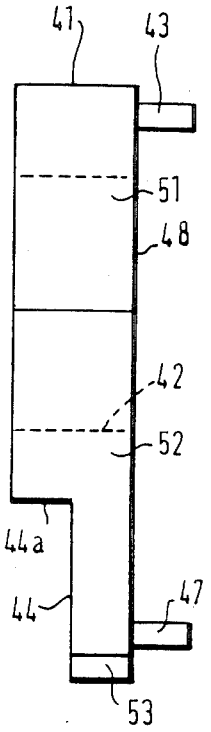

One embodiment of the invention will now be described with reference to the accompanying drawings:

FIG. 1 is a schematic view of the device of the present invention mounted on the exterior face of a wall, FIG. 2 is a diagrammatic perspective representation of a device of the present invention, FIG. 3 is a side elevation of the device of FIG. 2, FIG. 4 is a diagrammatic perspective representation of one member of the device of FIG. 2, FIG. 5 is a diagrammatic perspective representation of a second member of the device of FIG. 2, FIG. 6 is a plan view of a line guide block for use with the device of FIG. 1, and FIG. 7 is a side view of the guide block of FIG. 6.

Referring to FIGS. 2 to 5 of the drawings, a device 1 comprises a first member 10 and a second member 20.

First member 10 consists of a flat rectangular plate 19 having opposed parallel channels 11 and 12 formed by subjecting two opposite sides of plate 19 to two 90° bending operations. Elongate slots 13 and 14 are formed in plate 19 and preferably spaced apart a distance equivalent to one course (75 mm) of standard house bricks. The plate is attached to the face 3 of wall 2, as shown in FIG. 1, by means of two clamp studs 15 which each extend through a gap between brickwork courses and include flanges 18 formed at one end of the stud, which locate behind an adjacent brick. The opposite end of studs 15 are screwthreaded and pass through one of slots 13 and 14. Clamp studs 15 are provided with washers 16 and wing nuts 17 to secure the member 10 against the face 3 of the wall. As shown in the drawings only two clamp studs 15, one for each of slots 13 and 14, are used to secure member 10 to the wall, however, additional studs may be used if required.

Member 20 comprises a hollow rectangular section element 25 attached, through a space plate 31, to a rectangular flat channel bar 30 having a face 33 parallel to one side of the element 25. As shown in the drawings spacer plate 31 is attached at right angles to the edge of one face of element 25 and channel bar 30 attached by one of its ends to plate 31 so that it projects outwardly to one side of element 25. Channel bar 30 engages in channels 12 and 13 of member 10 and can be positioned at any point therealong. A screw-threaded hole 32 is formed in bar 30 and receives a correspondingly threaded bolt (not shown) which locks member 20 in any desired position relative to member 10 by causing face 33 of bar 30 to frictionally engage the inner walls of channels 12 and 13 when tightened against plate 19.

Rectangular hollow element 25 contains four screwthreaded holes 21–24 to receive correspondingly threaded adjustment screws (not shown). Holes 21 and 22 are formed at the top and bottom of outer face 26 and holes 23 and 24 are similarly formed in adjacent face 27. Pivots bars 28 and 29 are fixed to the inner walls of elements 25 on opposite faces to holes 21 and 24 about midway between the end portions of element 25 and at right angles to faces 26 and 27. Two further screw-threaded holes **28*a* and 29*a* are formed in faces 26 and 27 of element 25 directly opposite to bars 28 and 29** to receive correspondingly screw-threaded retaining bolts (not shown).

The lower end of a reference 5 (FIG. 1) is positioned within the hollow element 25 such that it extends below lower holes 22 and 24 formed in faces 26 and 27 respectively. The bolts threaded through holes **28*a* and 29*a* are then tightened to retain reference 5 against further downward or upward movement within element 25. Reference 5 is oriented in a true vertical position by adjustment of the said threaded screws, inserted through holes 22–26, to lock the reference 5 against the pivot bars 28–29**

In order to prevent the threaded bolts, used to orient reference 5, from damaging the sides of the reference, two flat metal shims may be inserted inside the hollow element 25 to lie adjacent reference 5 and between the reference and the threaded bolt holes. Alternatively, a single right angled shield of the type illustrated in FIG. 6 of my copending British application No. 8312165 may be employed for the same purpose.

In use, as shown in FIG. 1, member 10 is secured to face 3 of wall 2 with one edge positioned adjacent the right angled corner formed between face 3 and face 4. Channel bar 30 of member 10 is then slidably engaged in channels 11 and 12 and positioned and locked in position such that line 6, attached to reference 5, defines the building line after reference 5 has been adjusted, with the aid of a plumb line or spirit level, to extend vertically from element 25.

In the event that there is a substantial projection from the building line on face 4, for example a chimney breast, then the device can be rapidly repositioned to define the building line of the projection by slackening wing nuts 17 of studs 15 and sliding the whole of member 1 horizontally to the left and subsequently retightening the wing nuts to secure the device against wall 3 again. Any minor adjustment to the relative position of member 20 in respect to member 10 can then be made by slackening and retightening the threaded bolt passing through hole 32 in plate 30.

For building along face 3. member 10 may be re-positioned and secured to face 4 and member 20 turned through 180° before being re-engaged with member 10 and the device set up as described hereinbefore.

It is preferred that a reference 5, supported by the device of the present invention, is positioned at each end of the wall face being constructed and that the line 6 extends between these two references.

A guide block slidably engaging reference 5 may be employed to provide an additional reference parallel to reference 5 to permit the device of the present invention to be used in the simultaneous construction of two wall faces, e.g. 3 and 4 of FIG. 1. The second reference may be in the form of a peg extending from the bracket parallel to reference 5 and positioned so that the distance between the peg and reference 5 is equal to the width of the channel section of member 10 and the thickness of the walls of section 25, whereby a line attached to the peg will define a building line for face 3 in FIG. 1.

A suitable guide block is illustrated in FIGS. 6 and 7. The guide block generally indicated at 40, consists of a flat plate 41 having a stepped portion 44 with a shoulder 44*a*, rear edge 50, angled side edges 51 and 52, 51' and 52' and an angled front edge 53,53'. Pegs 43–47 project at right angles from the upper surface 48 of plate 41 and provides attachment points for reference lines, for example as illustrated in FIG. 1 item 6.

Guide 40 is a sliding fit over reference 5 and is retained in the required position by frictional engagement with the sides of the said reference, engagement being effective as a result of the tension forces applied by the reference lines causing the guides to twist in a horizontal plane and about the axis of reference 5 to "lock-on" to the reference. In order that accurate reference lines at right angled corner between two wall faces, as illustrated in FIG. 1, may be achieved it is necessary that the sides of the guide block along which the reference lines are to be aligned be angled to allow for the angular movement of plate 41 occurring during the "locking on" process referred to above. Angles $\theta$ and $\phi$ are thus determined by the differences in dimension of reference 5 and passageway 42. Thus in a device employing a reference 5 of 38.1 mm square section and a guide block having a passageway with a 41.38 mm square section, angle $\theta$ is 11° and angle $\phi$ is 8 degrees, the other dimensions of the block being, side 50, 60.3 mm; sides 51,51', 31.75 mm; sides 52,52', 54 mm; sides 53,53', 30.2 mm, stepped portion 44, 28.6 mm (maximum) shoulder 44*a*, 11 mm and an overall thickness of 19 mm. Dimension A and A' is 14.3 mm and B and B' is 11 mm.

In use, and with reference 5 adjusted to be vertical to enable two right angled faces (3,4) of wall (2) to be built up, guide 41 is first passed over reference 5 with the forward stepped portion 44 projection towards plate 19 and face 3. The guide is positioned at the required height and turned in a clockwise direction to frictionally engage reference 5. Reference lines are then tensioned between the device and references at the opposite ends of the wall faces to maintain the guide in the required position. The reference line for face 4 passes around peg 45 and is aligned with side 51', the reference line for face 3 is passed around peg 46 and aligned with side 53'. If guide 41 had been twisted in an anti-clockwise direction to make frictional engagement with reference 5, then the reference line would be aligned with sides 52' and 53 respectively.

If necessary in order to bring the reference line for face 4 in position vertically above the outside of the face the position of member 20 on face 19 may be adjusted by slackening the retaining bolt passing through hole 32 and sliding bar 30 along channels 11 and 12 to the required extent at the same time maintaining reference lines in a taut condition, and finally retightening the securing bolt.

Once the guide block has been set in position on the reference 5 then its vertical position may be altered simply by sliding the block upwardly above reference 5 to the next required position.

When guide 41, or reference line 6, approaches the upper end of reference 5 there may be a tendency for the reference to bow under the influence of the tension in a reference line or lines. This can be countered by the use of a stabilising member constructed and dimensioned to be attached to one face of a wall (or two faces at an internal corner) at a position between member 10 and the reference line or lines to maintain the reference member in a vertical orientation. Such stabilising member may consist of a hollow element, having the same internal dimension as member 25, attached to laterally extending arm portions adapted for attachment to a wall through suitable elongate nut and bolt arrangements. The arm portions may be slotted, to allow the stabiliser to be set at the required distance from a wall face or faces, and secured to the hollow element by nuts engaging threaded studs extending outwardly of the element and through the slots. Two adjacent walls of the hollow element may include threaded bolt holes to allow for fine adjustment of the vertical orientation of the reference member.

The device of the present invention is equally useful in providing a building line for both internal and external walls of a structure which may include projections such as chimney breasts or piers. It may be conveniently manufactured from readily available materials for example plate 19 may be formed from sheet steel and element 25 from metal (aluminum) extrusions.

I claim:

1. A device capable of supporting a reference for a building line comprising:

a first member releasably attachable to a footing or wall structure, and a second member releasably engageable with said first member whereby the relative position of said second member with respect to said first member is adjustable; said second member including a substantially vertically oriented hollow square section element having inner vertical walls and into which one end of a square section building line reference is in sliding engagement and threaded bolt holes provided at opposite ends of two adjacent walls thereof to receive adjustable bolt means adapted to act on the end of the reference to vary the vertical orientation thereof and to lock the reference in said orientation, and said hollow element further including two protrusions projecting inwardly of the two inner walls thereof opposite said adjacent sides, said protrusions extending substantially horizontally across said walls, and being positioned to face between said bolt holes in said adjacent walls.

2. A device according to claim 1, wherein further means are provided to lock said second member in a fixed position relative to said first member.

3. A device according to claim 1 wherein the protrusions are bars extending across the full width of said two side walls.

4. A device according to claim 1 wherein a reference guide line block slidably engages said reference member, said guide block comprising a flat plate having a planar upper surface and including a passageway through which said reference extends and reference line attachment pegs extending vertically from said surface, said guide block being arranged to frictionally engage said reference in a required position when two sides of the plate are parallel and adjacent to two right angled faces of a wall along which reference lines are to be aligned.

* * * * *